US008818230B2

(12) United States Patent
Murano

(10) Patent No.: US 8,818,230 B2
(45) Date of Patent: Aug. 26, 2014

(54) IMAGE FORMING APPARATUS

(75) Inventor: Junichi Murano, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 203 days.

(21) Appl. No.: 13/365,543

(22) Filed: Feb. 3, 2012

(65) Prior Publication Data

US 2012/0230720 A1 Sep. 13, 2012

(30) Foreign Application Priority Data

Mar. 10, 2011 (JP) ..... 2011-053362

(51) Int. Cl.
*G03G 21/20* (2006.01)

(52) U.S. Cl.
USPC ..... 399/92; 399/61

(58) Field of Classification Search
USPC ..... 399/92, 61
See application file for complete search history.

(56) References Cited

U.S. PATENT DOCUMENTS

| | | | | |
|---|---|---|---|---|
| 6,725,991 | B2 | 4/2004 | Murano et al. | |
| 6,779,975 | B2 | 8/2004 | Takashima et al. | |
| 7,106,990 | B2 | 9/2006 | Murano et al. | |
| 7,222,471 | B2 | 5/2007 | Matsumoto et al. | |
| 7,409,177 | B2 | 8/2008 | Murano et al. | |
| 7,720,415 | B2 | 5/2010 | Murano | |
| 7,748,540 | B2 | 7/2010 | Matsumoto et al. | |
| 2003/0047407 | A1 | 3/2003 | Murano et al. | |
| 2003/0053908 | A1 | 3/2003 | Takashima et al. | |
| 2004/0182048 | A1 | 9/2004 | Matsumoto et al. | |
| 2005/0095032 | A1 | 5/2005 | Murano et al. | |
| 2006/0210305 | A1 | 9/2006 | Murano et al. | |
| 2006/0226046 | A1 | 10/2006 | Matsumoto et al. | |
| 2007/0071484 | A1 * | 3/2007 | Igarashi | 399/92 |
| 2008/0240781 | A1 | 10/2008 | Murano | |
| 2009/0263155 | A1 | 10/2009 | Murano | |

FOREIGN PATENT DOCUMENTS

| | | | |
|---|---|---|---|
| JP | 2002-036662 | A | 2/2002 |
| JP | 2002-287602 | A | 10/2002 |
| JP | 2006-195357 | A | 7/2006 |
| JP | 2007-140349 | A | 6/2007 |

* cited by examiner

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

An image forming apparatus including an image forming unit to develop an electrostatic latent image formed on an image carrier with toner, an intake fan to draw air used for cooling the image forming unit into the image forming apparatus, an exhaust fan to exhaust the air from the image forming apparatus, and an exhaust duct to form an airflow path between the image forming unit and the exhaust fan. One end of the exhaust duct is disposed below the exhaust fan.

4 Claims, 6 Drawing Sheets

IMAGE FORMING APPARATUS

CROSS-REFERENCE TO RELATED APPLICATION

The present patent application is based on and claims priority pursuant to 35 U.S.C. §119 from Japanese Patent Application No. 2011-053362, filed on Mar. 10, 2011 in the Japan Patent Office, which is incorporated by reference herein in its entirety.

BACKGROUND OF THE INVENTION

1. Field of the Invention

Exemplary aspects of the present invention generally relate to an image forming apparatus such as a copier, a printer, a plotter, a facsimile machine, and a multifunction device having two or more of copying, printing, plotting, and facsimile capabilities.

2. Description of the Related Art

Related-art image forming apparatuses, such as copiers, printers, facsimile machines, and multifunction devices having two or more of copying, printing, and facsimile capabilities, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

Many components of the image forming apparatus such as the charger and the fixing device that perform image formation generate heat, and the heat thus generated increases the temperature within the image forming apparatus. If hot enough, for example, toner particles stored in the developing device can be melted together and coagulate, resulting in irregular images.

Accordingly, image forming apparatuses are typically provided with a cooling system that cools the interior of the apparatus. There is known, for example, a cooling system in which outside air is drawn into the image forming apparatus from the front of the apparatus using multiple fans to cool image forming units disposed in the image forming apparatus, after which the air is discharged from the rear of the apparatus. In another approach, a space through which air flows is foamed within the image forming apparatus between a developing device and an irradiating device having a heat source to cool an image forming unit disposed in the apparatus with air drawn into the space from the outside.

The image forming unit includes devices such as the developing device and the cleaning device that handle toner, and therefore, toner scattering is inevitable around those devices. In particular, toner having a smaller particle diameter that is now used in image forming apparatuses to meet increasing demand for higher-quality images tends to scatter more easily.

The related-art cooling systems described above focus only on cooling of the image forming units and do not consider relative positions of flows of cool air and scattered toner, thereby exacerbating toner scattering. Consequently, the scattered toner is attached to members that are handled during replacement or maintenance and soils users' hands.

BRIEF SUMMARY OF THE INVENTION

In view of the foregoing, illustrative embodiments of the present invention provide a novel image forming apparatus that cools an image forming unit disposed therein without toner scattering and prevents a user from getting soiled with toner upon replacement of components.

In one illustrative embodiment, an image forming apparatus includes an image forming unit to develop an electrostatic latent image formed on an image carrier with toner, an intake fan to draw air used for cooling the image forming unit into the image forming apparatus, an exhaust fan to exhaust the air from the image forming apparatus, and an exhaust duct to form an airflow path between the image forming unit and the exhaust fan. One end of the exhaust duct is disposed below the exhaust fan.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
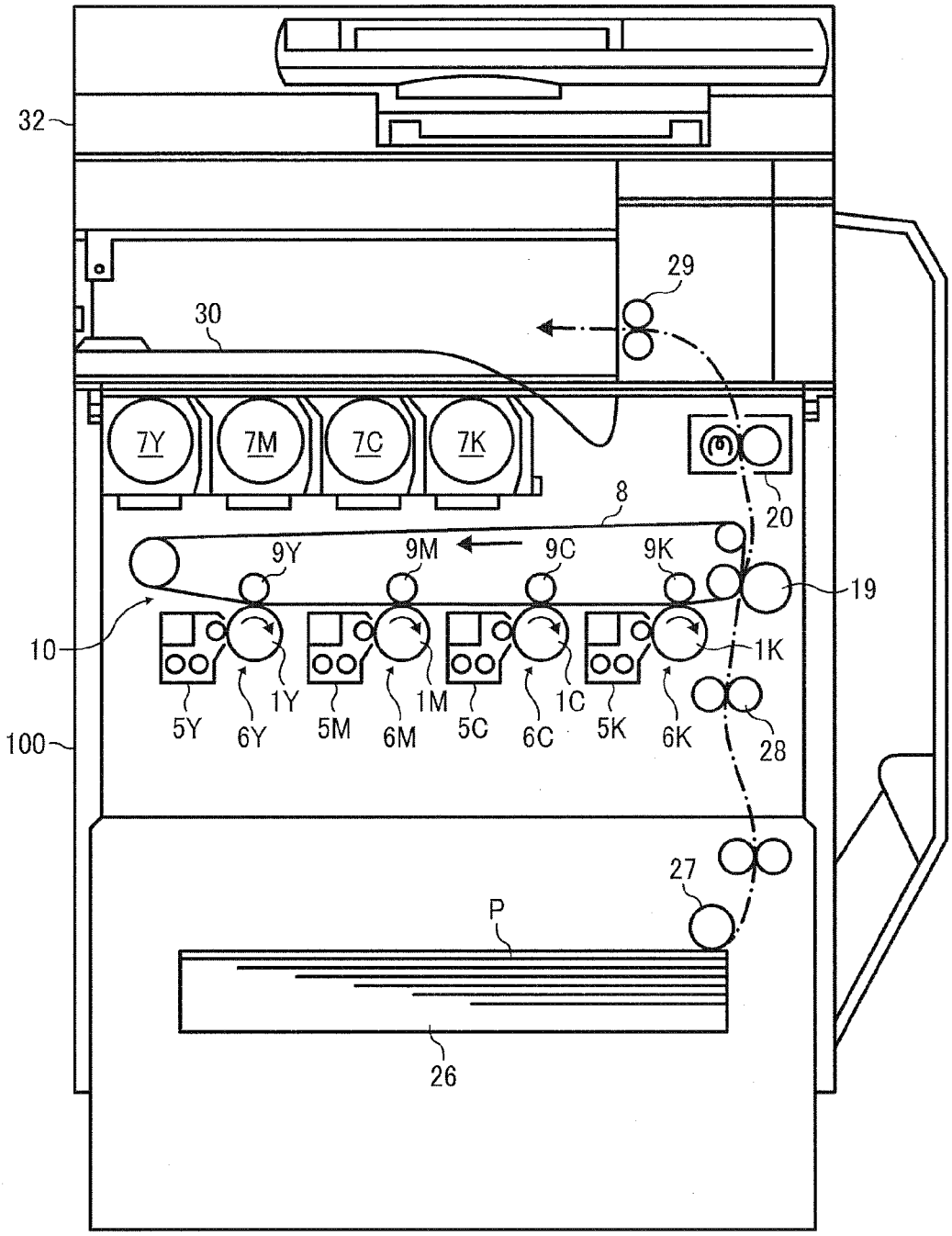
FIG. 1 is a vertical cross-sectional view illustrating an example of a configuration of an image forming apparatus according to an illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Figure 2:
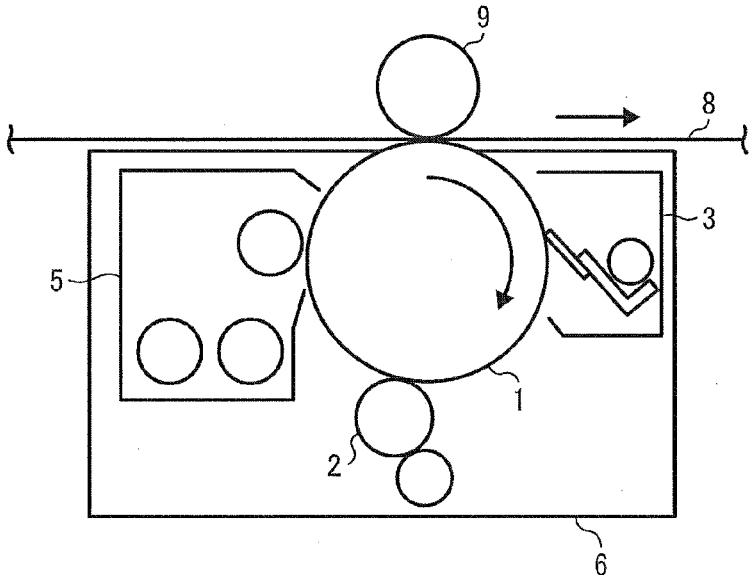
FIG. 2 is an enlarged schematic view illustrating an example of a configuration of an image forming unit included in the image forming apparatus illustrated in FIG. 1.

A configuration and operation of an image forming apparatus 100 according to an illustrative embodiment are described in detail below, with reference to FIGS. 1 and 2. FIG. 1 is a vertical cross-sectional view illustrating an example of a configuration of the image forming apparatus 100. FIG. 2 is an enlarged schematic view illustrating an example of a configuration of one of image forming units 6 included in the image forming apparatus 100.

The image forming apparatus 100 includes image forming units 6Y, 6M, 6C, and 6K (hereinafter collectively referred to as image forming units 6), each forming an image of a specific color, that is, yellow (Y), magenta (M), cyan (C), or black (K). The image forming units 6 are arranged side by side along a lower surface of an unfixed image carrier, which, in the present illustrative embodiment, is an intermediate transfer belt 8 included in an intermediate transfer unit 10. The image forming units 6 have the same basic configuration, differing only in a color of toner used. In FIG. 2, only one of the image forming units 6 is shown as a representative example without the suffixes Y, C, M, and K. Each of the image forming units 6 includes a latent image carrier, which, in the present illustrative embodiment, is a photoconductor 1Y, 1M, 1C, or 1K (hereinafter collectively referred to as photoconductors 1), a charger 2, a developing device 5Y, 5M, 5C, or 5K (hereinafter collectively referred to as developing devices 5), and a cleaning device 3, each provided around the corresponding photoconductor 1. It is to be noted that, the charger 2 and the cleaning device 3 are omitted in FIG. 1 for ease of illustration.

Toner containers, which, in the present illustrative embodiment, are toner bottles 7Y, 7M, 7C, and 7K (hereinafter collectively referred to as toner bottles 7) are provided above the image forming units 6. The toner bottles 7 are withdrawably installed in the image forming apparatus 100 from a front side of the image forming apparatus 100, and are connected to the developing devices 5, respectively, by pipes to supply toner to the corresponding developing devices 5. A configuration of the toner bottles 7 is described in greater detail later.

Figure 4:
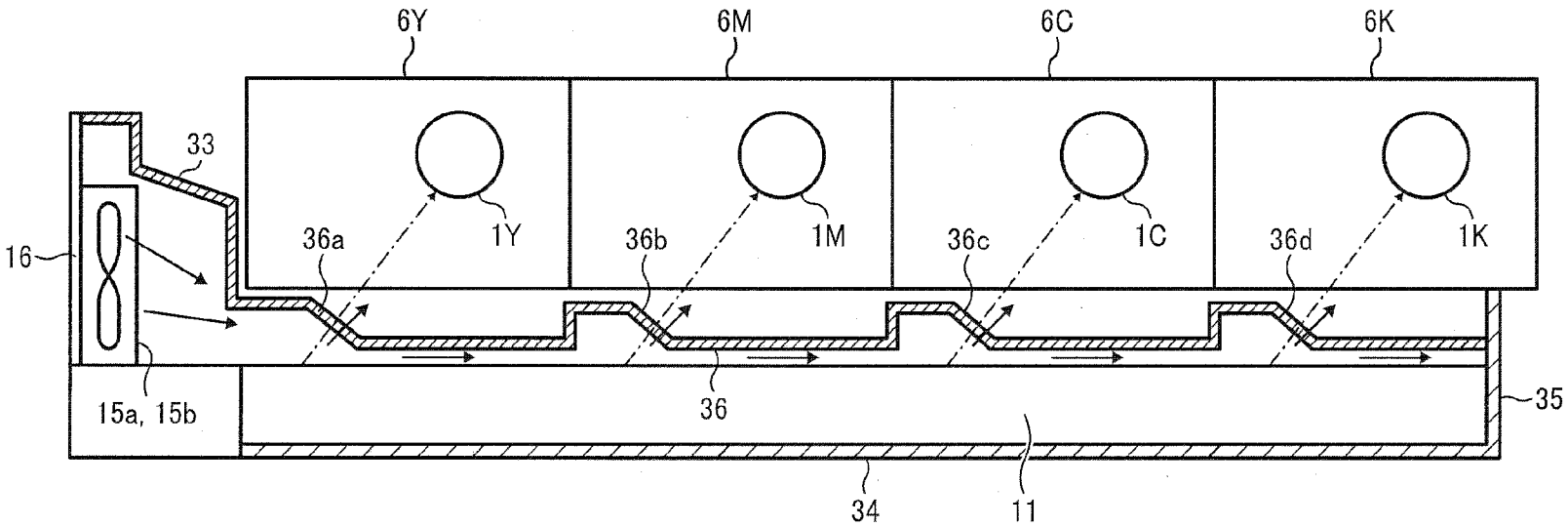
FIG. 4 is a schematic view illustrating flows of air for cooling image forming units disposed in the image forming apparatus.

A description is now given of image formation performed on each of the photoconductors 1 with reference to FIG. 2. Image forming process including the steps of charging, irradiation, development, transfer, and cleaning is performed on each of the photoconductors 1 to form a desired toner image, respectively. Specifically, each of the photoconductors 1 is rotatively driven by a drive unit, not shown, in a clockwise direction, and a surface of each of the photoconductors 1 is evenly charged by the corresponding charger 2. A light beam emitted from an irradiating device 11 provided below the image forming units 6 as illustrated in FIG. 4 is directed onto the charged surface of each of the photoconductors 1 to form an electrostatic latent image on the surface of each of the photoconductors 1. Each of the developing devices 5 supplies toner of the specified color to the electrostatic latent image thus formed to develop the electrostatic latent image with the toner. Accordingly, a toner image of the specified color is formed on the surface of each of the photoconductors 1. The toner image thus formed is then conveyed to a primary transfer roller 9Y, 9M, 9C, or 9K (hereinafter collectively referred to as primary transfer rollers 9) provided opposite the corresponding photoconductors 1 with the intermediate transfer belt 8 interposed therebetween. Each of the primary transfer rollers 9 primarily transfers the toner image onto the intermediate transfer belt 8 from the surface of each of the photoconductors 1. Thereafter, the surface of each of the photoconductors 1*t* is cleaned by the corresponding cleaning device 3 so that residual toner is removed from the surface of each of the photoconductors 1, and each of neutralizing rollers, not shown, initializes an electric potential on the surface of each of the photoconductors 1, respectively, to complete the sequence of image formation performed on each of the photoconductors 1.

The above-described sequence of image formation is performed in each of the image forming units 6. Specifically, laser beams are directed onto the surfaces of the photoconductors 1 from the irradiating device 11 based on image data to form electrostatic latent images of the specified colors on the surfaces of the photoconductors 1, respectively. The electrostatic latent images are then developed with toner by the developing devices 5 so that toner images of the specified colors are formed on the surfaces of the photoconductors 1, respectively. The toner images are then sequentially transferred from the surfaces of the photoconductors 1 onto the intermediate transfer belt 8 by the primary transfer rollers 9 and are superimposed one atop the other to form a single full-color toner image on the intermediate transfer belt 8.

The primary transfer rollers 9 are provided opposite the photoconductors 1 with the intermediate transfer belt 8 interposed therebetween so that primary transfer nips are formed between the intermediate transfer belt 8 and the photoconductors 1, respectively. A transfer bias having a polarity opposite a polarity of toner is supplied to each of the primary transfer rollers 9.

The intermediate transfer belt 8 is rotated in a counterclockwise direction in FIG. 1 to sequentially pass through the primary transfer nips. Thus, the toner images formed on the surfaces of the photoconductors 1 are sequentially transferred and superimposed one atop the other on the intermediate transfer belt 8 so that a single full-color toner image is formed on the intermediate transfer belt 8. The full-color toner image thus formed is then conveyed to a secondary transfer roller 19 provided opposite the intermediate transfer belt 8 as the intermediate transfer belt 8 rotates. The secondary transfer roller 19 secondarily transfers the full-color toner image from the intermediate transfer belt 8 onto a recording medium such as a sheet P which is conveyed to a secondary transfer nip formed between the secondary transfer roller 19 and the intermediate transfer belt 8 at a predetermined timing. Thus, the sequence of transfer of the toner image performed on the intermediate transfer belt 8 is completed.

The image forming apparatus 100 further includes sheet feed trays 26 disposed at a bottom portion of the image forming apparatus 100. Each of the sheet feed trays 26 stores a stack of multiple sheets P, and a sheet feed roller 27 separates the sheets P one by one to feed each of the sheets P. It is to be noted that only one of the sheet feed trays 26 is shown in FIG. 1 for ease of illustration. Conveyance of the sheet P thus fed by the sheet feed roller 27 is temporarily stopped by a pair of registration rollers 28. After a skew of the sheet P is corrected, the pair of registration rollers 28 conveys the sheet P to the secondary transfer nip at a predetermined timing. Accordingly, the full-color toner image is secondarily transferred onto the sheet P from the intermediate transfer belt 8 at the secondary transfer nip.

The sheet P having the transferred full-color toner image thereon is then conveyed to a fixing device 20. In the fixing device 20, a fixing roller and a pressure roller supply heat and pressure to the sheet P so that the full-color toner image is fixed onto the sheet P. The sheet P having the fixed full-color image thereon is then discharged to a discharge unit 30 provided at an upper portion of the image forming apparatus 100 by a pair of discharge rollers 29. Thus, the image forming process performed by the image forming apparatus 100 is completed.

It is to be noted that reference numeral 32 in FIG. 1 denotes a reading unit.

Figure 3:
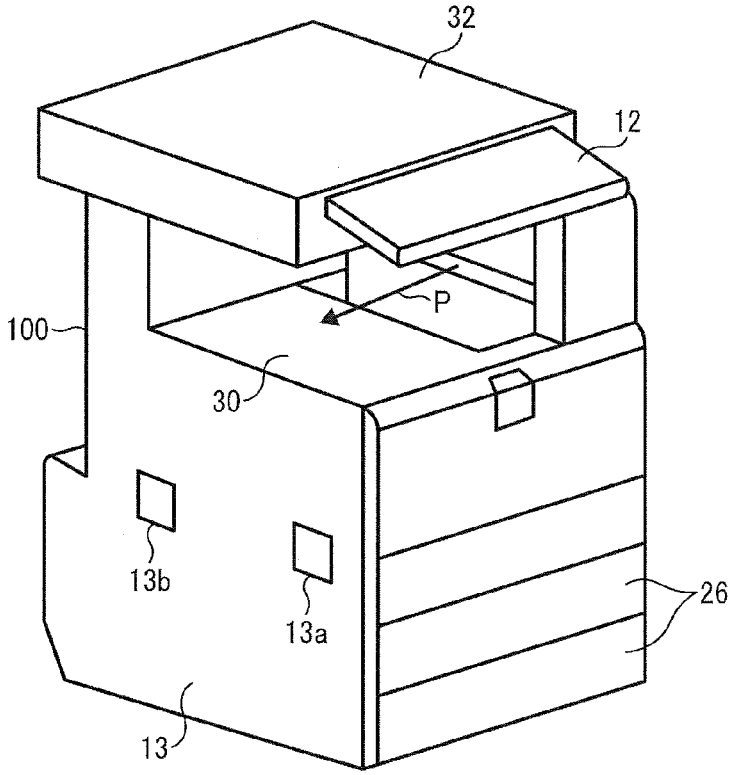
FIG. 3 is a perspective view illustrating an external appearance of the image forming apparatus illustrated in FIG. 1.

FIG. 3 is a perspective view illustrating an external appearance of the image forming apparatus 100. A control panel 12 is provided on the front side of the image forming apparatus 100. A left cover 13 of the image forming apparatus 100 has two air intake openings 13*a* and 13*b* therein from which outside air is drawn into the interior of the image forming apparatus 100.

FIG. 4 is a schematic view illustrating flows of air drawn into the image forming apparatus 100. Axial-flow fans 15*a* and 15*b* are provided to an inner surface of the left cover 13 via fan brackets 16 at the intake openings 13*a* and 13*b*, respectively. The irradiating device 11 is disposed in a space encompassed by front and back lateral plates 17 and 18, respectively, both of which are shown only in FIG. 7, upper and lower partition plates 33 and 34, respectively, and a right partition plate 35. The upper partition plate 33 includes a writing partition plate 36 and is extended along a lower surface of each of the image forming units 6. As indicated by solid arrows in FIG. 4, the outside air drawn from the axial-flow fans 15*a* and 15*b* into the image forming apparatus 100 flows between the irradiating device 11 and the upper partition plate 33 and enters each of the image forming units 6 from optical path openings 36*a*, 36*b*, 36*c*, and 36*d* provided in the writing partition plate 36 to cool the image forming units 6.

Figure 5:
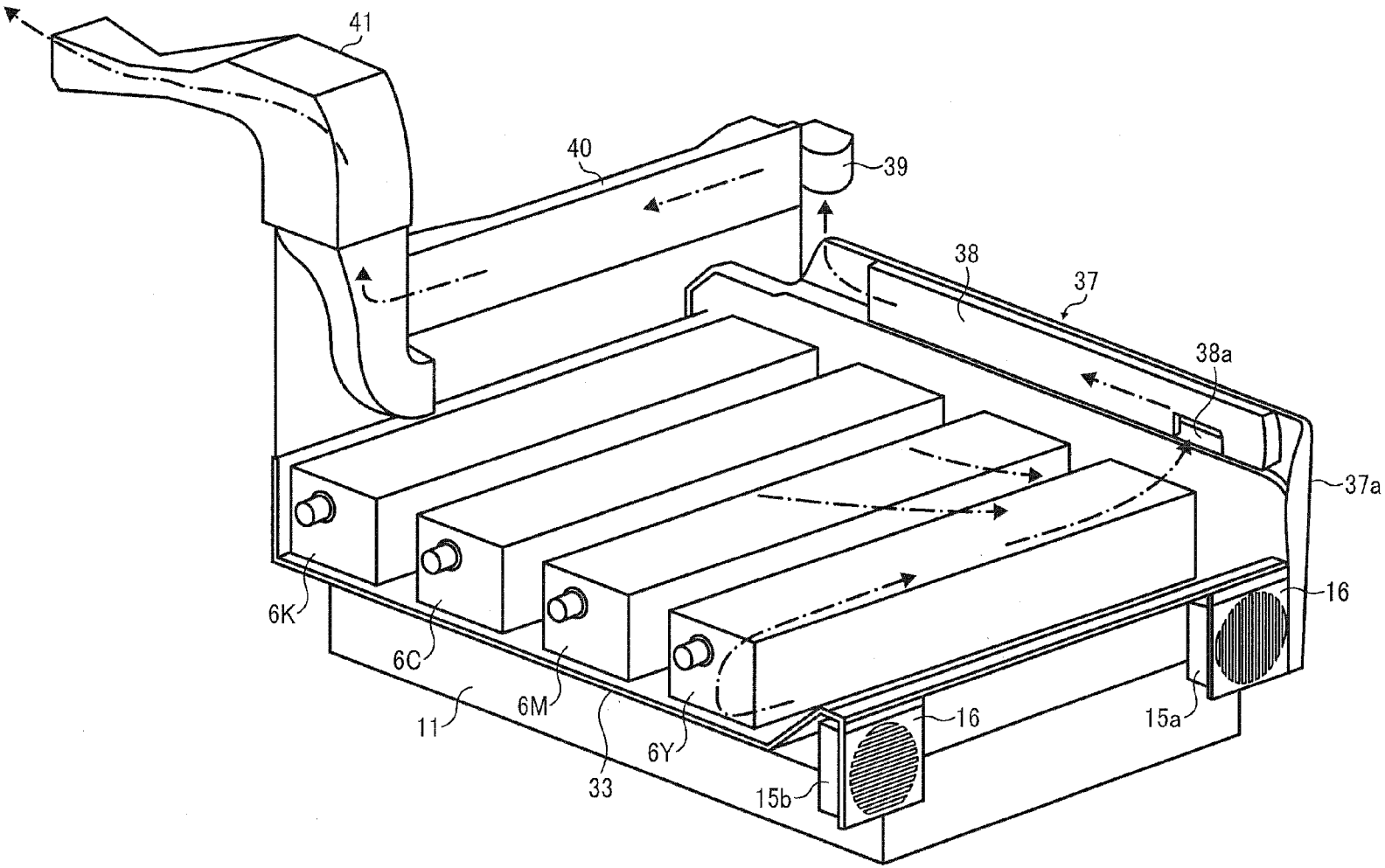
FIG. 5 is a perspective view illustrating exhaustion of air from the image forming apparatus using exhaust ducts.

FIG. 5 is a perspective view illustrating exhaustion of air from the image forming apparatus 100. A positioning member 37 that positions each of the image forming units 6 and holds them in place is provided on the front side of the image forming apparatus 100 and has a cover 37*a*. A first exhaust duct 38 is provided to an inner surface of the cover 37*a*. The first exhaust duct 38 is extended horizontally in a direction of arrangement of the image forming units 6 on the front side of the image forming apparatus 100, and one end of the first exhaust duct 38 is provided below an exhaust fan, which, in the present illustrative embodiment, is a sirocco fan 39. Air sucked in by the sirocco fan 39 is discharged outside the image forming apparatus 100 via second and third exhaust ducts 40 and 41 connected to the sirocco fan 39.

Each of the fan brackets 16 has multiple slits therein that function as a filter. The first exhaust duct 38 has a suction opening 38*a* provided near the image forming unit 6Y, which is disposed closest to the axial-flow fans 15*a* and 15*b*. Because the air flowing near the axial-flow fans 15*a* and 15*b* is strong, toner scattering tends to occur near the axial-flow fans 15*a* and 15*b*. The suction opening 38*a* provided near the axial-flow fans 15*a* and 15*b* efficiently sucks out the air together with toner to prevent toner scattering.

The air entering from the lower surface of each of the image forming units 6 to cool the image forming units 6 is then guided to the front side of the image forming apparatus 100 to flow through the first exhaust duct 38 via the suction opening 38*a* and is sucked in by the sirocco fan 39. A part of the air after cooling the image forming units 6 flows above the developing devices 5 and the cleaning devices 3 respectively included in the image forming units 6 and cools the developing devices 5 and the cleaning devices 3. As illustrated in FIG. 5, the air flowing above the image forming units 6 near the axial-flow fans 15*a* and 15*b* is guided to the suction opening 38*a*.

Figure 6:
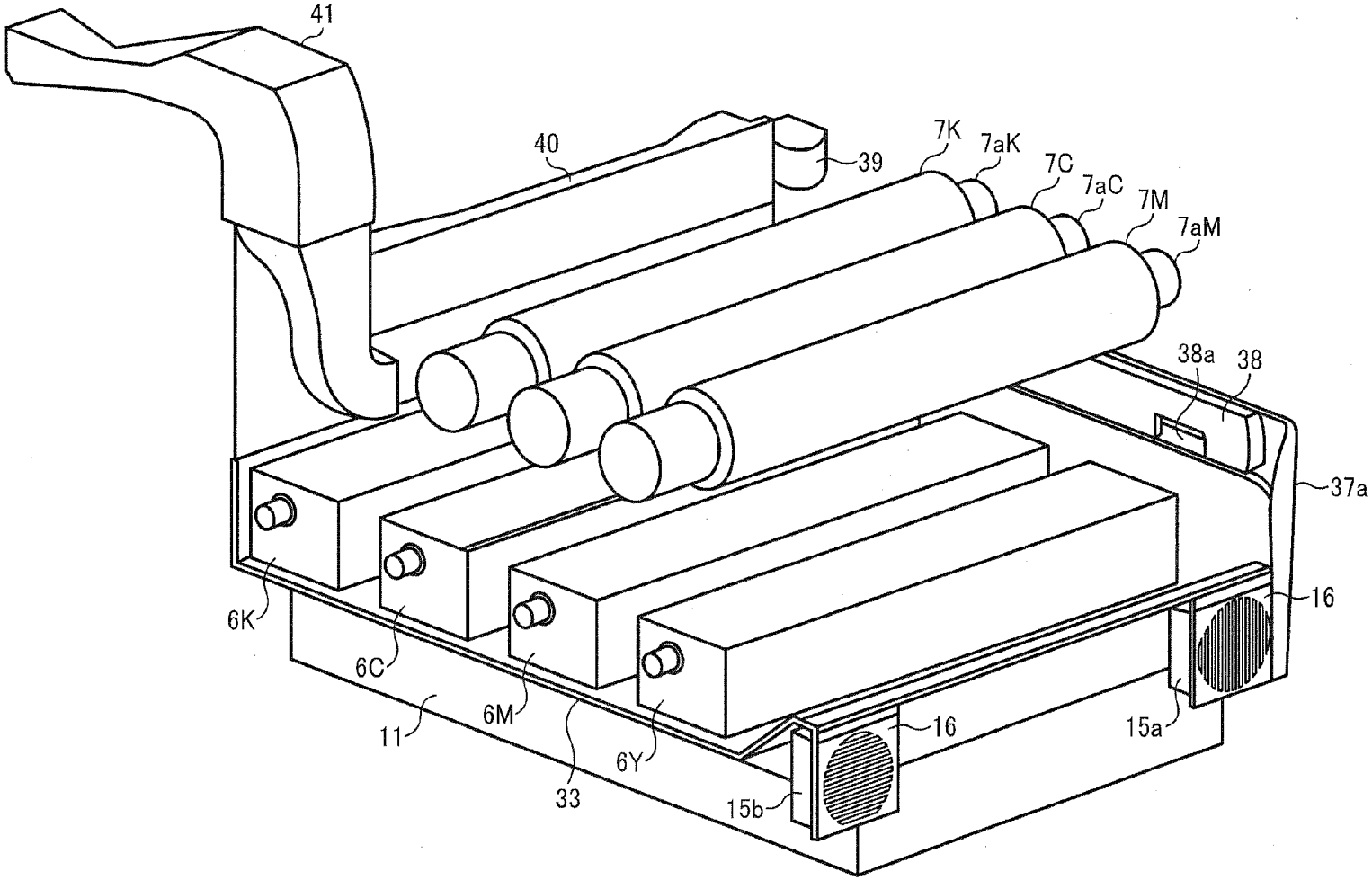
FIG. 6 is a perspective view illustrating relative positions of a first exhaust duct and toner bottles disposed in the image forming apparatus.

FIG. 6 is a perspective view illustrating relative positions of the first exhaust duct 38 and the toner bottles 7 in the image forming apparatus 100. The first exhaust duct 38 is provided below handles 7*a*Y, 7*a*M, 7*a*C, and 7*a*K (hereinafter collectively referred to as handles 7*a*) of the toner bottles 7. Accordingly, both the bodies and the handles 7*a* of the toner bottles 7 are prevented from getting soiled with toner. As a result, a user is prevented from getting soiled with toner upon replacement of the toner bottles 7, thereby improving maintenance. It is to be noted that the toner bottle 7Y and the handle 7*a*Y are omitted in FIG. 6 for ease of illustration.

Figure 7:
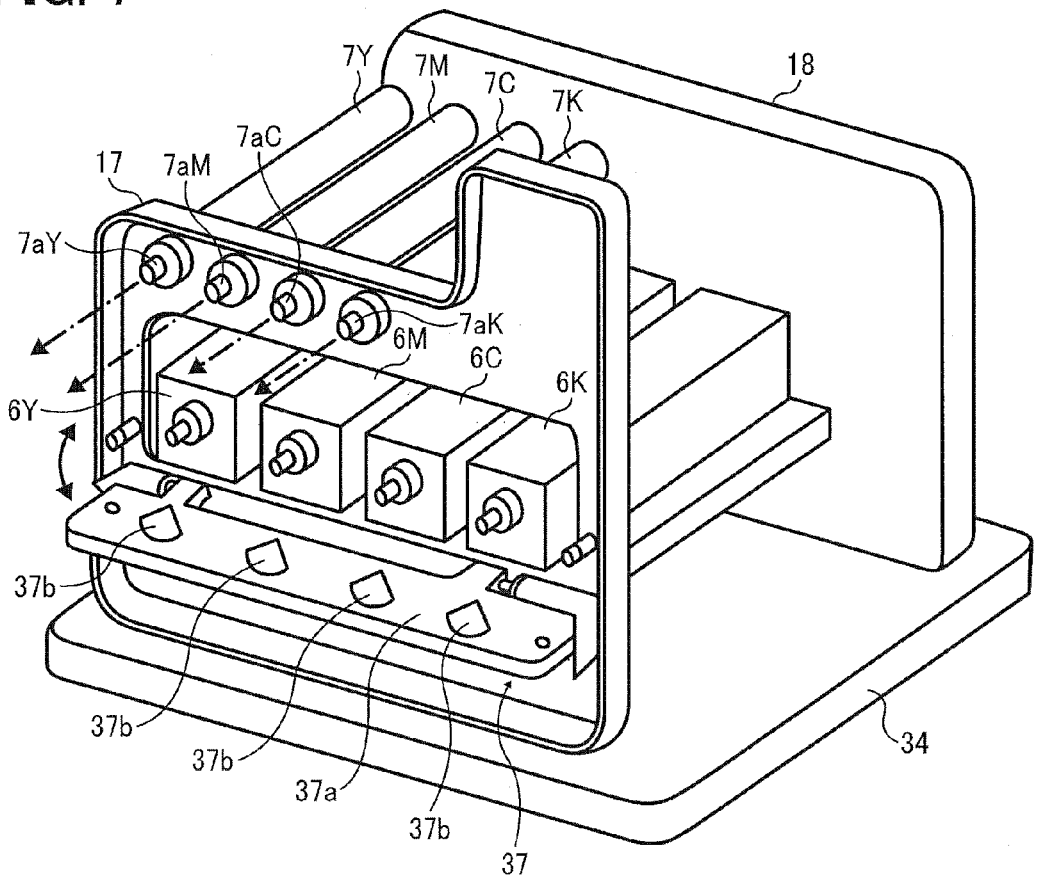
FIG. 7 is a perspective view illustrating positioning of the toner bottles and the image forming units in the image forming apparatus.

FIG. 7 is a perspective view illustrating positioning of the toner bottles 7 and the image forming units 6 in the image forming apparatus 100. The toner bottles 7 are supported by both the front and back lateral plates 17 and 18, and the handles 7*a* of the toner bottles 7 protrude from the front lateral plate 17, respectively. Upon replacement of the toner bottles 7, a front cover of the image forming apparatus 100 is opened and the handles 7*a* are grasped to pull out and detach the toner bottles 7 from the image forming apparatus 100. Because the cover 37*a* of the positioning member 37 is opened together with the front cover of the image forming apparatus 100, the first exhaust duct 38 is hidden under the cover 37*a* and not shown by the user upon replacement of the toner bottles 7. Therefore, in a case in which the first exhaust duct 38 gets soiled with toner, contamination of the first exhaust dust 38 is not shown by the user even when the front cover of the image forming apparatus 100 is opened.

A lower edge of the cover 37*a* is hinged so the cover 37*a* is rotatable in a vertical direction. Support holes 37*b* that respectively support drum shafts of the photoconductors 1 are formed on the cover 37*a* corresponding to the image forming units 6 to position the image forming units 6 in the image forming apparatus 100. Upon detachment of the image forming units 6 from the image forming apparatus 100, the cover 37*a* is opened downward and the image forming units 6 are pulled out of the image forming apparatus 100.

Figure 8:
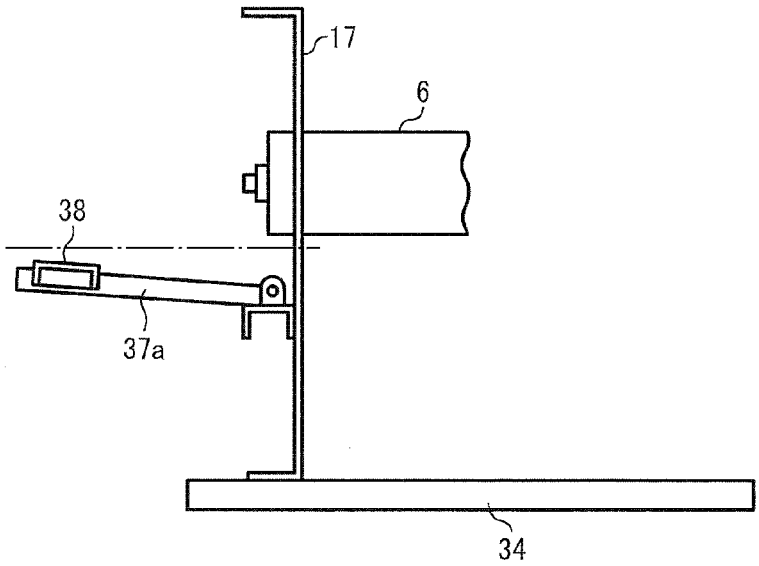
FIG. 8 is a vertical cross-sectional view illustrating relative positions of the first exhaust duct and the image forming units in the image forming apparatus.

FIG. 8 is a vertical cross-sectional view illustrating relative positions of the first exhaust duct 38 and the image forming units 6 in the image forming apparatus 100 with the front cover 37*a* opened. As can be seen from FIG. 8, the first exhaust duct 38 is positioned on the inner surface of the cover 37*a* below a plane of installation/detachment of each of the image forming units 6 in the image forming apparatus 100 as indicated by a broken line in FIG. 8. Accordingly, the first exhaust duct 38 does not prevent installation and detachment of the image forming units 6 in and from the image forming apparatus 100. It is to be noted that the first exhaust duct 38 is omitted in FIG. 7 for ease of illustration.

The above-described configuration achieves easy installation and detachment of the image forming units 6 in and from the image forming apparatus 100, thereby improving usability and operability of the image forming apparatus 100.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

an image forming unit to develop an electrostatic latent image formed on an image carrier with toner;

a toner container withdrawably installable in the image forming apparatus above the image forming unit;

an exhaust fan to exhaust air from the image forming apparatus; and an exhaust duct to form an airflow path between the image forming unit and the exhaust fan, one end of the exhaust duct being disposed below the toner container, wherein the toner container has a handle and the exhaust duct is disposed below a horizontal plane of the handle of the toner container.

2. An image forming apparatus comprising:

an image forming unit to develop an electrostatic latent image formed on an image carrier with toner;

a toner container withdrawably installable in the image forming apparatus above the image forming unit;

an exhaust fan to exhaust air from the image forming apparatus;

an exhaust duct to form an airflow path between the image forming unit and the exhaust fan, one end of the exhaust duct being disposed below the toner container; and a positioning member to position the image forming unit relative to a body of the image forming apparatus, wherein the exhaust duct is provided to an inner surface of the positioning member.

3. The image forming apparatus according to claim 2, wherein:

the positioning member is hingedly disposed on the front side of the image forming apparatus and is closable and openable;

the image forming unit is withdrawably installable in the image forming apparatus from the front side of the image forming apparatus; and the exhaust duct is positioned outside a plane of installation/detachment of the image forming unit in which the image forming unit is installed in and detached from the image forming apparatus.

4. An image forming apparatus comprising:

an image forming unit to develop an electrostatic latent image formed on an image carrier with toner;

an exhaust fan to exhaust air from the image forming apparatus; and an exhaust duct to form an airflow path between the image forming unit and the exhaust fan, one end of the exhaust duct being disposed below the exhaust fan; and multiple image forming units, wherein the exhaust duct is provided with a suction opening near the image forming unit closest to the intake fan.

* * * * *